US006443431B1

(12) United States Patent
Stasny et al.

(10) Patent No.: US 6,443,431 B1
(45) Date of Patent: Sep. 3, 2002

(54) LOAD COMPENSATED RIGHT ANGLE DIAMOND SCREW LEVELWIND

(75) Inventors: James Stasny, College Station; Joe Janac, Somerville; Dean Carey, Bryan; Toby Selcer, College Station, all of TX (US)

(73) Assignee: Dynacon, Inc., Bryan, TX (US)

( * ) Notice: Subject to any disclaimer, the term of this patent is extended or adjusted under 35 U.S.C. 154(b) by 68 days.

(21) Appl. No.: 09/703,225

(22) Filed: Oct. 31, 2000

(51) Int. Cl.[7] ..... B66F 1/00

(52) U.S. Cl. ..... 254/385; 254/335; 242/157.1; 242/397.3; 242/548.1

(58) Field of Search ..... 254/277, 335, 254/385, 386; 242/157, 157.1, 615, 615.1, 548.1, 397.2, 397.3

(56) References Cited

U.S. PATENT DOCUMENTS 1,941,250 A * 12/1933 Dale ..... 242/157.1
3,144,998 A * 8/1964 Back ..... 242/157.1
3,964,522 A 6/1976 Kao et al.
4,143,834 A 3/1979 Hara et al.
4,354,608 A * 10/1982 Wudtke ..... 254/277
4,410,297 A 10/1983 Lynch
4,538,937 A 9/1985 Lynch
4,577,810 A * 3/1986 Sandvik ..... 242/157.1
4,692,063 A 9/1987 Conti
4,767,073 A 8/1988 Malzacher
4,967,973 A * 11/1990 Murnane ..... 242/157.1
5,845,868 A 12/1998 Klerelid et al.
5,950,953 A 9/1999 Baugh

* cited by examiner

*Primary Examiner*—Emmanuel M. Marcelo
(74) *Attorney, Agent, or Firm*—McHale & Slavin

(57) ABSTRACT

A cable winding system has a powered spool for receiving the cable in continuous evenly distributed coils. A levelwind mechanism is attached to the spool and guides the cable onto the spool by a pawl traversing a powered diamond screw groove. The levelwind is attached to a load compensated hydraulic system which prevents stresses from being transmitted to the pawl. The levelwind has a sheave to accept cable angularly disposed to the axis of the spool.

2 Claims, 3 Drawing Sheets

LOAD COMPENSATED RIGHT ANGLE DIAMOND SCREW LEVELWIND

FIELD OF THE INVENTION

This invention relates to cable spooling systems in which the cable is fed to and from the spool by a levelwind mechanism that distributes the cable along the axis of the spool. More particularly, the lateral movement of the levelwind follows the path of a pawl traveling in a groove formed as a diamond screw in the surface of a roller oriented parallel to the axis of the spool. The levelwind is connected to a load compensated hydraulic system which absorbs the transitory and constant loads on the cable thereby removing stress from the pawl.

BACKGROUND OF THE INVENTION

In the general field of oceanography, there are numerous applications for towed arrays wherein a ship will pay out and retrieve cable. The applications include such diverse fields as exploration, exploitation and national defense, among others. In these fields, cables may be used to tow payloads, such as remotely operated vehicles (ROV) and SONAR arrays or the cable, itself, may serve as the operative component, such as communications, power or carrying various spaced sensors. During operations, the roll of the ship or grounding of the array may cause random surges in pressure which is transmitted by the cable to the on board equipment.

Also, the depths or distances required by these applications necessitate a handling and storage system that is compact and can manipulate heavy loads. Due to the work environment, these systems must perform repeatedly without significant maintenance.

The retrieval equipment must have a control system to compensate for the random variations of pressure required during operations and retrieval. Conventionally, the systems can be adjusted so as not to exceed the tensile strength of the cable. While this protects the cable, there also needs to be a compensation mechanism to protect the equipment.

Conventional ship board installations of cable spools require that the axis of the spool be perpendicular to the direction in which the cable is being payed out or retrieved. There is also a need for a system in which the cable spool may be placed at an angle, other than 90 degrees, to the direction of the payed out cable.

DESCRIPTION OF THE PRIOR ART

Hara et al, U.S. Pat. No. 4,143,834 discloses a wire winding device which has a levelwind operated by a feeding screw. In one embodiment, a guide roller is used with the levelwind.

Baugh et al, U.S. Pat. No. 5,950,953, discloses a cable winding apparatus having guide rollers operated by a diamond screw levelwind.

Another cable spooling system which uses a diamond screw levelwind is described in U.S. Pat. No. 4,767,073 for winding electrical cables on drilling rigs. In this system, there is a guide mechanism which has a pawl continuously traversing the diamond screw shaft to evenly distribute the cable onto the spool. The cable is payed out and retrieved through the guide in a direction perpendicular to the axis of the spool. An idler wheel, with an axle parallel to the axis of the spool, is used to reduce the cable pressure on the pawl of the diamond screw. The idler wheel is spring loaded to accept variations in the load of the paid out cable. Any sudden or prolonged increase in pulling force on the cable may overcome the resistence of the springs on the idler wheel and transmit the force to the pawl. For winding the cable on the spool, the spool is powered by a pressure-compensated hydraulic system which reacts to the pulling load on the cable to prevent damage to the cable. However, in operation, this pressure compensation is subsequent to the cable passing over the idler wheel and pawl so that the pawl will be subjected to increased loads even as the spool is stopped.

A mobile load compensated cable winding device is disclosed by Conti, U.S. Pat. No. 4,692,063, in which pressure transducers are used to control a hydraulic winding mechanism and the movement of the vehicle.

There are numerous other levelwind systems using the diamond screw guide but the conventional systems suffer from increased wear between the pawl and the diamond screw because the cable loads are transferred to the pawl.

SUMMARY OF THE INVENTION

This invention teaches an improvement to winches utilizing diamond screw levelwinds. The diamond screw levelwind, as instantly described, will allow the levelwind to operate with minimal load on the drive pawl. The diamond screw levelwind is widely utilized because of its reputation for simple and reliable mechanical operation. The problem generally encountered centers around the fact that the relatively small follower or drive pawl, which is generally formed from bronze, and which runs in the diamond groove, is limited in the load it can safely handle. If this device is utilized in high load capacity winches, very high maintenance and/or a high failure rate in the field often result. Thus in high load situations, electro-active levelwind devices are often used. A need exists for a sub-sea right angle levelwind with a fairly high line pull winch. A diamond screw type device would be an acceptable choice, but for the need for high loading, which causes excessive pawl wear. The instantly taught improvement effectively isolates the line pull component by using a hydraulic cylinder in combination with a load sensing device to counterbalance the line pull component, thereby only requiring the levelwind pawl to deal with the friction component of the levelwind.

It is an objective of this invention to provide a cable spooling system having a diamond screw and pawl levelwind in which the pawl is not subjected to the cable load.

Another objective of this invention is to provide a cable winding system with a winding guide in the form of a sheave rotating on an axis oriented at 90 degrees to the spool axis.

It is another objective of this invention to provide a load compensated hydraulic power assisted carriage carrying the sheave and the pawl.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
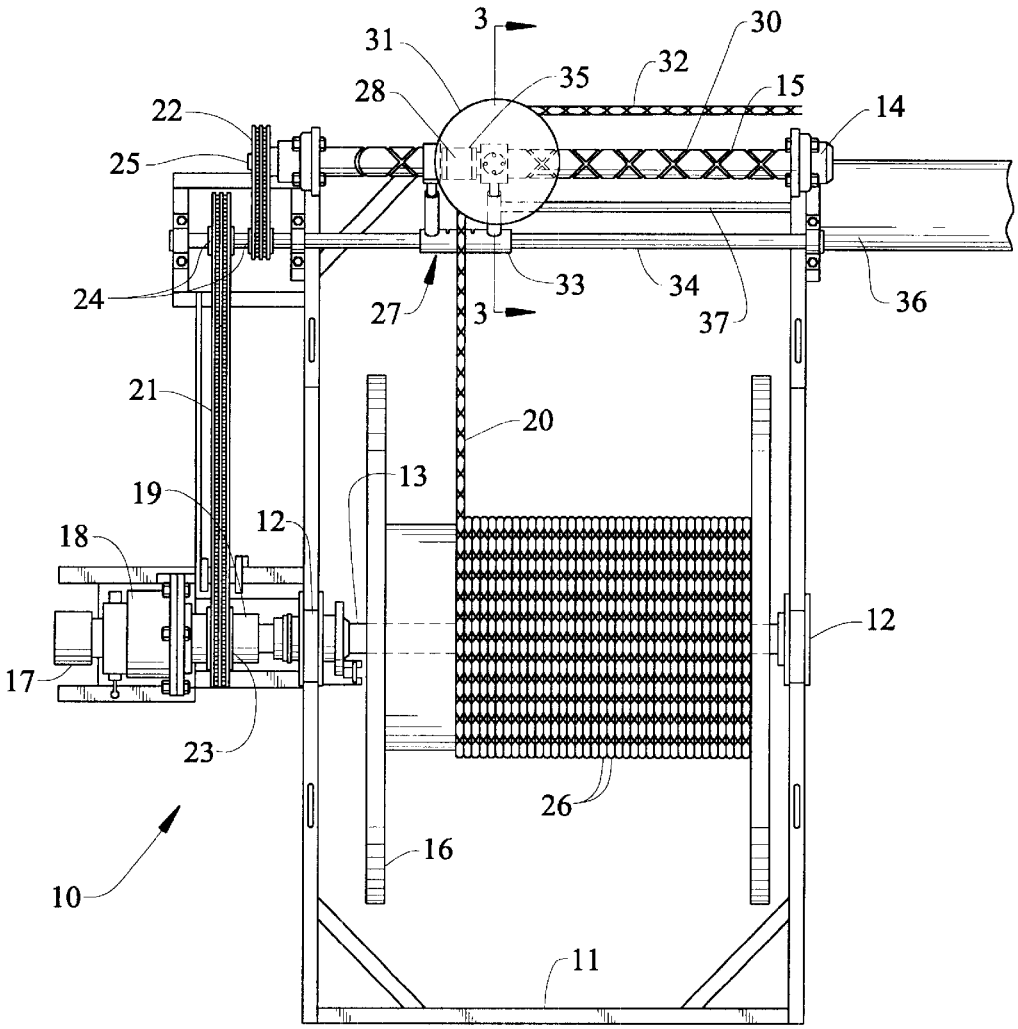
FIG. 1 shows a top plan view of the cable winding system of this invention with the sheave in phantom lines.

With reference to FIG. 1, a frame 11 is suitable for mounting on ship board. The frame contains bearing journals 12 and 14 for the spool axle 13 and the diamond screw 15. The spool 16 may have an integral axle or it may be removably mounted on axle 13. Axle 13 is driven by hydraulic motor 17 through a torque hub 18 and a coupler 19. The torque hub 18 may be adjusted to a limit for preventing stretching or breakage of the cable 20. The coupler 19 provides a removable connection between the axle 13 and the motor 17. The diamond screw 15 is also driven by a connection to the torque hub 18. As shown, chain drive elements 21 and 22 connect the torque hub and the diamond screw 15 by sprockets 23, 24 and 25 though other drive mechanisms, such as a drive shaft or belts or the like, could be employed. As winding torque increases on the torque hub 18, the motor 17 begins to slow thereby maintaining a constant load on the cable and the coils 26 on the spool 16. If the pre-set limit set for the torque hub 18 is reached the motor 17 stops.

Figure 3:
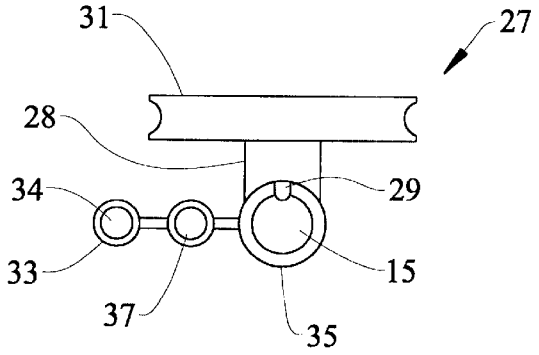
FIG. 3 shows a partial cross section through the carriage along line 3—3 of FIG. 1.
Figure 4:
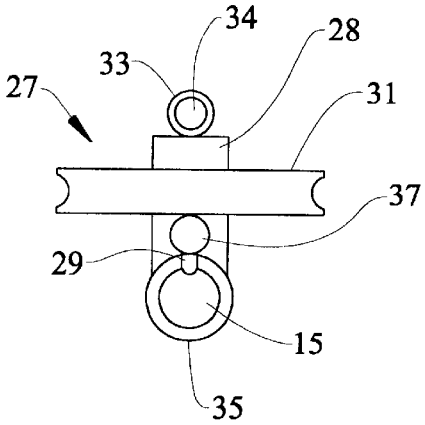
FIG. 4 shows a cross section through the carriage of a modification of this invention.

The levelwind mechanism 27 has a carriage 28 which carries a pawl 29, shown in FIGS. 3 and 4, which follows the groove 30 in the diamond screw 15. The carriage 28 also carries a sheave 31 with an axis of rotation perpendicular to the axis of rotation of the spool 16. The sheave 31 allows the frame 11 to be mounted on ship board at an angle to the paid out direction of the cable. As shown in FIG. 1, the free end 32 of the cable forms an angle of approximately 90 degrees with the coils 26 though this angle may vary in particular installations.

Figure 2:
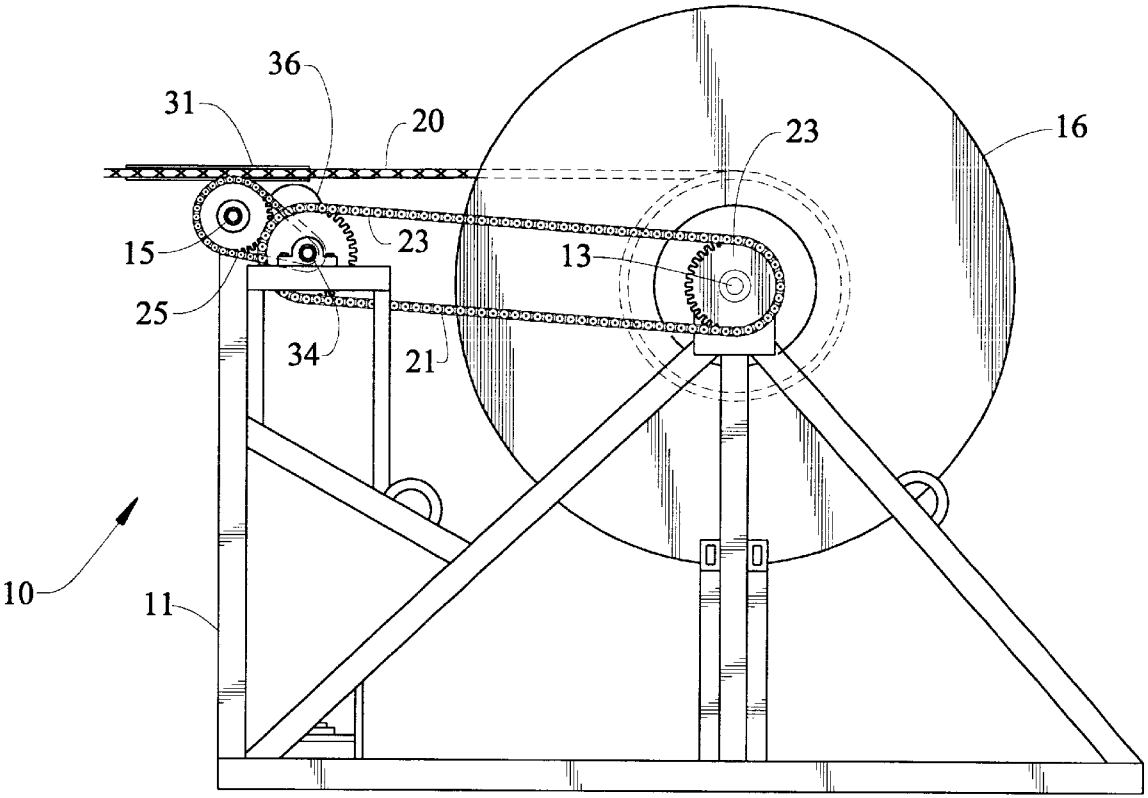
FIG. 2 shows a side elevation view.

The carriage 28 includes a sleeve 33 which slides back and forth along a guide rod 34. Another carriage sleeve 35 slides along the diamond screw 15. The sleeves 33 and 35 cooperate with the guide rod 34 and diamond screw 15 to stabilize the carriage 28 from twisting forces during the movement of the cable. In FIG. 2, the guide rod 34 and the diamond screw 15 are shown in different horizontal planes or different heights above the deck. This orientation is used for illustration purposes only and is not to be considered as limiting.

FIG. 3 shows the cross section through line 3—3 of FIG. 1 with the guide rod 34, piston rod 37 and diamond screw 15 laterally co-planar.

In FIG. 4, the carriage 28 if formed with an upper and lower section connected together by the axle of the sheave 31. In this embodiment, the sheave is oriented between the guide rod 34 and the diamond screw 15. Each of the sleeves 33 and 35 are mounted on a section of the carriage. The piston rod 37 is shown attached to the lower carriage section however, it may be affixed to the upper section as a matter of choice. In this embodiment, the guide rod 34, diamond screw 15 and piston rod 37 are co-planar vertically.

To protect the levelwind 27 and prevent excessive wear on the pawl 29, the carriage 28 is connected to a hydraulic cylinder 36 by piston rod 37. The hydraulic cylinder 36 is operated by a load compensated hydraulic pump 38. In FIG. 1, the hydraulic cylinder 36 is shown as located on the same side of the frame 11 as the free end 32 of the cable. This requires the piston rod 37 to push against the total weight the payed out cable. In such an arrangement, the piston rod must withstand the compression without deformation. In the preferred embodiment (not shown) the hydraulic cylinder 36 is on the opposite side of the frame 11 from the free end 32 of the cable. In this embodiment, the piston rod 37 pulls against the weight of the payed out cable which allows a smaller piston rod.

Figure 5:
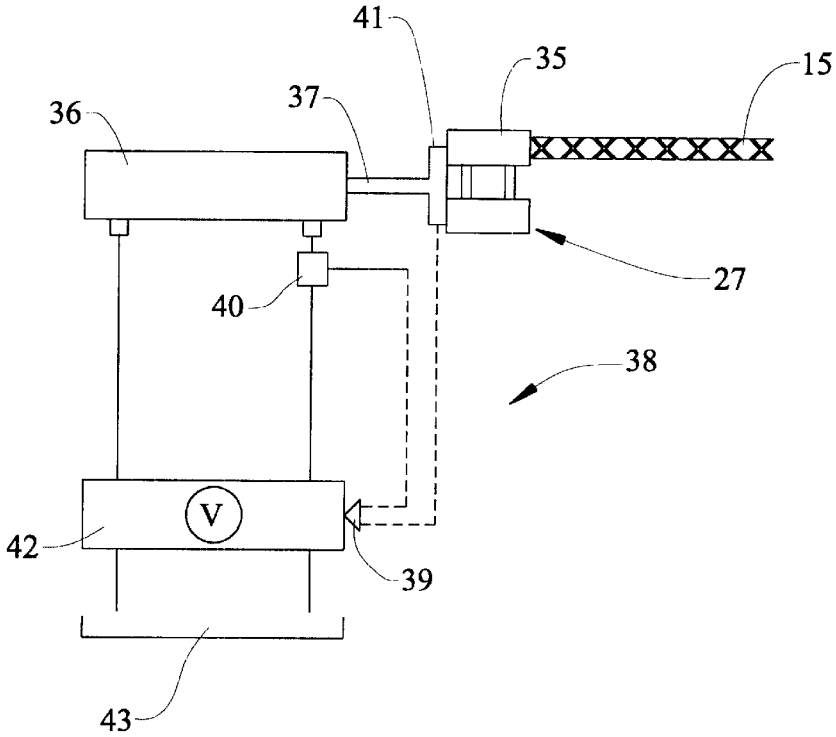
FIG. 5 shows schematic diagram of the hydraulic control of the invention.

The load compensated hydraulic pump 38, shown in FIG. 5, is operated by a load signal processor 39 which receives a signal from a pressure transducer 40 on the hydraulic cylinder and a reference signal from pressure transducer 41 between the carriage and the piston rod 37. The load signal processor 39 relays this information to the electronic pressure control valve 42 to operate the hydraulic piston 37. The electronic control valve controls hydraulic flow to and from the cylinder and a hydraulic reservoir 43.

The electronic pressure control valve 42 may be manually set to a value below the pressure that would injure the cable. In one embodiment, the electronic pressure control valve halts flow when the signal from the load signal processor 39 reaches the pre-set limit, thereby locking up the levelwind 27. In this manner, all the pressure of the payed out cable is taken by the hydraulic system and not transferred to the pawl 29 in the diamond screw 15. The pawl 29 becomes merely a director rather than a weight bearing component.

In operation, the spooling system limits for the torque hub and the electronic pressure control valve are set and the system is powered up. This may be accomplished by reciprocating engine, turbine, or electric motor running a hydraulic motor. The cable is payed out under constant strain as the spool and diamond screw are rotated. In this mode, the cable spool may be free-wheeling or controlled by the powered system. The pawl in the levelwind carriage follows the groove in the screw directing the rotating sheave to traverse the guide rod unrolling the coils evenly. Any random pressure surges, as well as constant strain, on the cable will be absorbed by the hydraulically operated carriage. Upon retrieval, the limits are pre-set for the torque hub and the levelwind and the cable spool is turned to re-wind the payed out cable. Any sudden increase in cable pressure will be detected by the pressure transducers in the carriage and hydraulic piston and instantly communicated to the pressure control valve. The increased load will be compensated for thereby allowing the pawl in the levelwind to continue without additional stress, up to the pre-set limit. At the limit, the control valve will stop flow thereby locking up the levelwind under hydraulic pressure. This stoppage will be transmitted to the torque hub through the cable and the winding will stop.

It is to be understood that while a certain form of the invention is illustrated, it is not to be limited to the specific form or arrangement of parts herein described and shown. For example, the system may be used to spool any material formed as continuous strands, such as wire, string, rope, line, hose, or the like. It will be apparent to those skilled in the art that various changes may be made without departing from the scope of the invention and the invention is not to be considered limited to what is shown and described in the specification and drawings.

What is claimed is:

1. In a spooling system for evenly distributing continuous coils about a rotating spool having a levelwind mechanism including a diamond screw having an axis of rotation parallel to the axis of rotation of said spool, said diamond screw having a continuous groove formed thereon and a carriage slidably mounted on said diamond screw, said carriage comprising a pawl mounted on said carriage and adapted to follow said groove, a piston rod connected at one end to said carriage and connected at the other end to a hydraulic system, said hydraulic system including a means for detecting the load on said carriage and automatically applying hydraulic pressure through said piston rod to compensate for said load.

2. In a spooling system of claim 1 wherein said carriage includes a sheave rotatably mounted thereon: said sheave having an axis of rotation perpendicular to said axis of rotation of said diamond screw.

* * * * *